US005081439A

United States Patent [19]

Natzle et al.

[11] Patent Number: 5,081,439

[45] Date of Patent: Jan. 14, 1992

[54] THIN FILM RESISTOR AND METHOD FOR PRODUCING SAME

[75] Inventors: Wesley C. Natzle, Wappingers Falls; H. Bernhard Pogge, Hopewell Junction; Kerry L. Batdorf, Poughkeepsie, all of N.Y.

[73] Assignee: International Business Machines Corporation, Armonk, N.Y.

[21] Appl. No.: 615,938

[22] Filed: Nov. 16, 1990

[51] Int. Cl.[5] ..... H01C 10/10

[52] U.S. Cl. ..... 338/195; 338/308; 338/309; 219/121.68; 219/121.69; 29/620

[58] Field of Search ..... 338/195, 308, 309; 219/121.68, 121.69; 29/620, 610.1

[56] References Cited

U.S. PATENT DOCUMENTS 3,996,551 12/1976 Croson ..... 338/309

*Primary Examiner*—Marvin M. Lateef

*Attorney, Agent, or Firm*—Perman & Green

[57] ABSTRACT

A planar film resistor is trimmable by a laser beam. A pair of electrodes are spaced apart on a substrate and make contact with a film of resistive material disposed therebetween. The resistive material includes a laser produced trim region disposed internally to all boundaries of the resistive material, and extends through the thickness of said film. The trim region has an elongated dimension which is orthogonal to the most direct current path between the electrodes. In a preferred embodiment, the resistive material is covered by a passivating layer and is trimmed after the passivating layer is in place.

17 Claims, 2 Drawing Sheets

FIG. 3
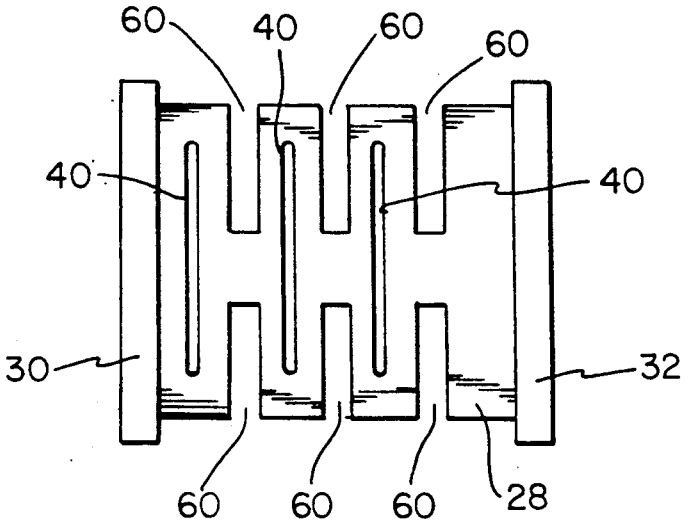
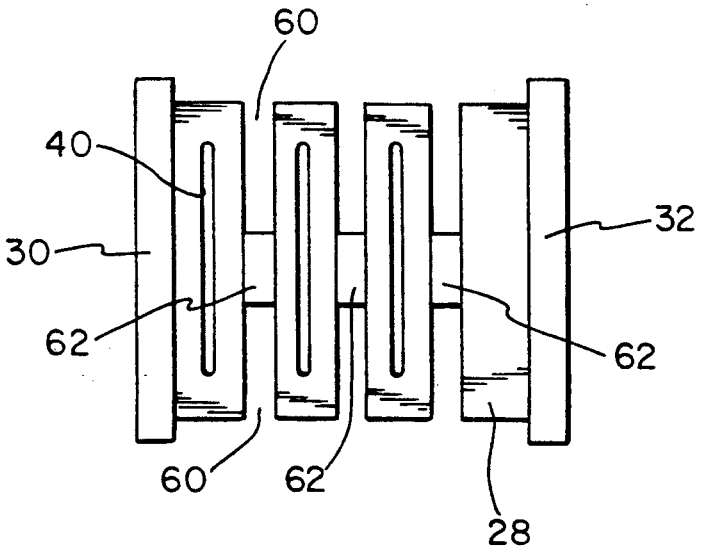
FIG. 4

THIN FILM RESISTOR AND METHOD FOR PRODUCING SAME

FIELD OF THE INVENTION

This invention relates to thin film resistors, and more particularly, to a thin film resistor which can be reliably and highly accurately trimmed after it has been covered with one or more overlayers.

BACKGROUND OF THE INVENTION

Resistors in the form of relatively thin films of resistive material deposited between electrical contacts are well known in the art. These resistors typically include a metal component and may further comprise an oxide or a semiconductor component. The resistance of such thin film resistors are often adjusted by removing, etching, abrading, etc., portions of the resistor material.

When a thin film resistor is positioned on a cylindrical substrate, the prior art indicates that it can be trimmed by forming a helical groove, via laser erosion, in a conductive film which coats the resistor (U.S. Pat. No. 4,566,936 to Bowlin), or by cutting a plurality of helically oriented, narrow grooves in the resistance film to decrease the amount of resistive material between opposing contacts (U.S. Pat. No. 3,509,511 to Soroka).

When a film resistor is configured on a planar substrate, a number of techniques are taught in the prior art for trimming the resistance value. In one configuration, a film of resistive material is located between the ends of a pair of conductive terminals so as to create a "top hat", with the terminals defining the hat brim. Removing the film material progressively from either the bottom or the top of the top hat modifies the amount of resistive material (and thus the resistance value) between the contacts. Such trimming methods are shown in U.S. Pat. Nos. 3,573,703 to Burks et al., and 4,163,315 to Neese.

A number of prior patents teach the trimming of a planar resistor by initially positioning an erosion instrument (e.g. an electro-erosion head, laser beam, etc.) outside the limits of the resistor and slowly bringing it within the boundaries of the resistor so that a kerf is created in the resistive material. Such a technique, and variations thereof, can be found in U.S. Pat. Nos. 3,889,223 to Sella et al., 3,947,801 to Bube, 4,159,461 to Kost et al., 4,352,005 to Evans et al., 4,443,782 to d'Orsay, 4,551,607 to Moy, 4,647,899 to Moy, and 4,785,157 to Gofuku et al. In the latter patent, in addition to cutting a kerf into the resistive material, the resistance is irradiated in chosen areas to change local resistance characteristics. The common feature to the above mentioned patents is that each teaches that the erosion of the resistance material commences from outside and then proceeds inwardly into the resistive material.

The prior art also teaches that the resistance value of a film resistor can be modified by maintaining the erosion instrument totally within the limits of the resistive material. For instance, in U.S. Pat. Nos. 4,205,297 and 4,301,439, both to Johnson et al., a film type resistance is provided with a central contact and an exterior contact located at the resistor's periphery. The resistor is trimmed by cutting a spiral pattern in the resistive material to, essentially, elongate the resistive path between the central contact and the exterior contact. In U.S. Pat. No. 4,582,976 to Merrick, a trimming technique is disclosed wherein a substantially rectangular-shaped film resistor is trimmed by removing an internal portion of the resistive material to create an opening therein that is parallel to the long dimension of the resistor.

Similar types of trimming techniques have also been applied to planar capacitive structures (e.g. see U.S. Pat. Nos. 3,394,386 to Weller et al., 3,402,448 to Heath and 3,597,579 to Lumley).

Of the above indicated trimming techniques, the most widely used is laser-based. Those systems commence the trim action by positioning a laser beam outside of the boundary of the resistor, and then traversing the beam across the edge and into the body of the resistor. While this method is efficient in terms of obtaining a maximum change in resistance, it presents a number of problems when applied to recent semiconductor/thin film resistor structures. Such structures typically comprise a silicon masterslice with a plurality of layers of personalizing metallization and intervening quartz, nitride, or other insulating ceramic materials disposed therebetween. Two, three or more of such complex layers can often be found on a masterslice, with thin film resistors disposed within such structures. Often, resistors are placed on the uppermost surface and are passivated with an additional layer of a sputtered quartz material.

It is preferred that the thin film resistors be trimmed after the semiconductor device is completely fabricated (i.e. after the final layer of quartz passivation has been deposited over the resistors). Because the passivating quartz layer seals the surface of the thin film resistors, care must be taken to assure that the amount of material vaporized by an incident laser beam is such that the thus created vapor pressure does not rupture the quartz layer. It is also desirable that trimming be accomplished using a method that produces a wide range of very precise and reliable resistance values for the least amount of trim action and within the least amount of resistor "real estate." Further, the trimming action should be accomplished rapidly, with the highest efficiency and with the least expenditure of laser energy.

These objectives are partially accomplished by making the thickness of the thin film resistor the minimum that will provide the required resistance value. The trim action is preferably adjusted so as to provide the desired change of resistance in the shortest period of trim time. Traditionally, a laser cutting procedure which proceeds from the outside boundary of a thin film to the inside has been utilized. In thin film resistors passivated with an overcoat of quartz, the use of such a trim procedure can cause defects at the entrance of the trim cut into the resistor material. The primary problem appears to be that the trim process does not always remove all of the material at the edge. The material which remains can, in some cases, act as an electrical bridge element across the cut and present a reliability exposure.

A possible solution to the edge defect problem would be to increase the power of the laser above that which would otherwise be required. In addition to potentially injuring the overlying quartz layer, such action might tend to anneal, and thus change the characteristics of, underlying semiconductor structures. Another possible solution might be to provide added trims at the entrance to the cut, however, this would require additional time for the trim action and reduce production throughput.

Accordingly, it is an object of this invention to provide a thin film resistor structure and trim technique that yields resistors with a wide range of accurate and reliable resistor values and is achievable on resistor structures of minimum "real estate".

Another object of this invention is to provide a method for trimming thin film resistors that does not induce undesirable structural effects in the vicinity of the irradiated region.

It is a further object of this invention to provide a method for trimming a planar thin film resistor covered by a rigid overlayer.

SUMMARY OF THE INVENTION

A planar film resistor is described that is trimmable by a laser beam. A pair of electrodes are spaced apart on a substrate and make contact with a film of resistive material disposed therebetween. The resistive material includes a laser produced trim region disposed internally to the perimeter of the resistive material, the region having an elongated dimension which is parallel to the electrode/resistive material interfaces. In a preferred embodiment, the resistive material is covered by a passivating layer and is trimmed after the overlayer is in place.

DESCRIPTION OF THE DRAWINGS

FIG. 3 is a plan view of a planar film resistor configuration which enables a large resistance change for a minimum trim action.

FIG. 4 is a modification of the planar film resistor of FIG. 4.

DETAILED DESCRIPTION OF THE INVENTION

Figure 1:
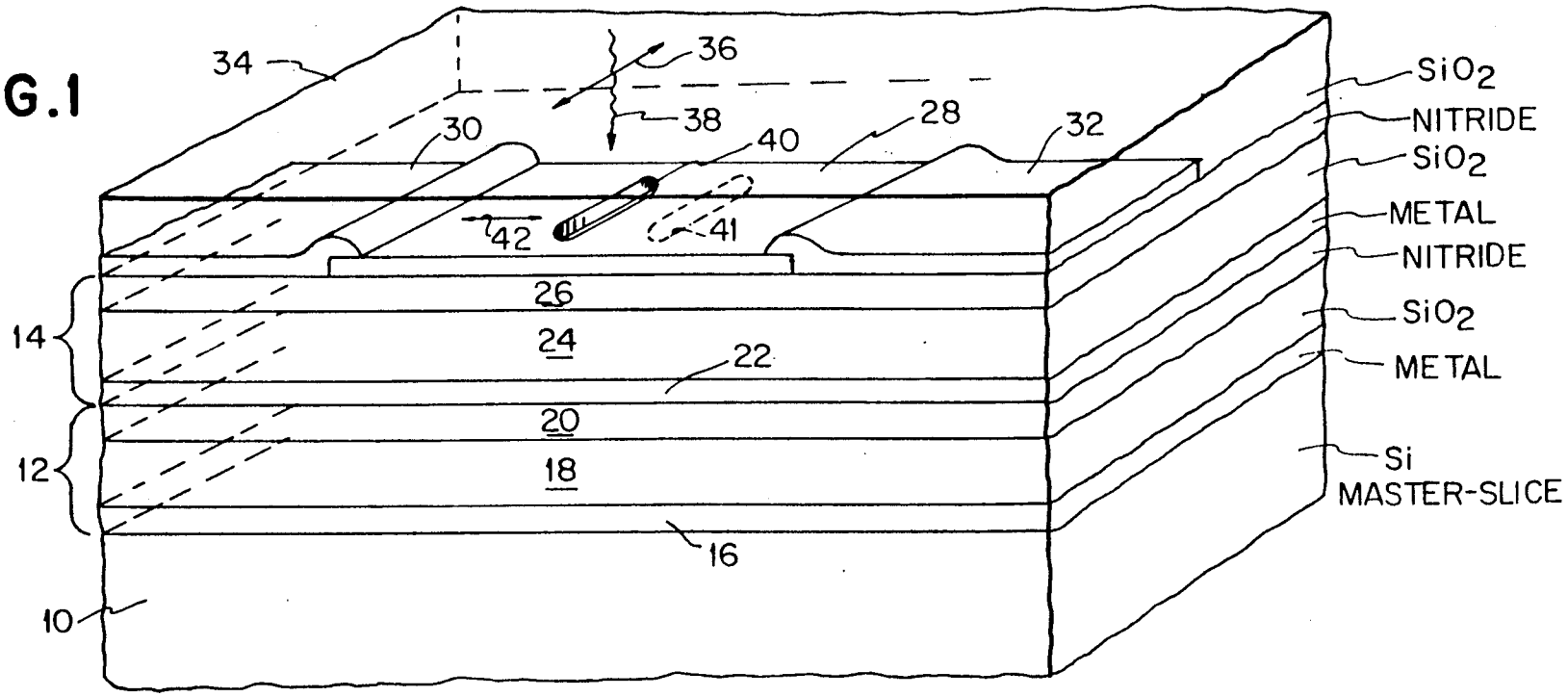
FIG. 1 is a section/perspective view of a semiconductor structure having a planar film resistor, trimmed in accordance with the invention.

FIG. 1 is the schematic view of a semiconductor structure with a resistor mounted thereon that has been trimmed in accordance with the invention. It should be noted that FIG. 1 is not drawn to scale. The semiconductor structure comprises a silicon masterslice 10 that includes a multiplicity of active devices formed therein (not shown). A pair of personalization layers 12 and 14 are emplaced on the surface of masterslice 10 and perform the function of interconnecting various of the devices in the masterslice, in the well known manner. Personalization layer 12 comprises a metallization layer 16 which includes metal conductors that interconnect the various semiconductors in masterslice 10. Disposed over metallization layer 16 is an $SiO_2$ passivating layer 18 on which a nitride layer 20 is deposited. An additional personalization layer 14 includes a further metallization layer 22, $SiO_2$ layer 24 and nitride layer 26.

Disposed on nitride layer 26 is a thin film planar resistor 28 which interfaces at either of its extremities with conductive contacts 30 and 32. Contacts 30 and 32 are connected via conductive lines (not shown) to one or more personalization layers 12 and 14 to enable resistor 28 to interconnect to various of the devices in silicon masterslice 10. Of course, a plurality of resistors 28 will generally be present on nitride layer 26 and only one is shown for exemplary purposes.

A passivating $SiO_2$ layer 34 is emplaced over contacts 30, 32 and resistor 28. In the production process, it is often the case that resistor 28 needs to be trimmed to adjust its resistance value, so that the semiconductor circuit exhibits proper operating characteristics. If the trim occurs prior to all processing steps being completed, the resistance and/or other circuit parameters may shift during subsequent steps, notwithstanding the trim action. Thus, it is most desirable that the trim operation take place in the final phases of the chip and/or device process so that device operation can be adjusted to the appropriate specifications.

Since the overlayer 34 has already been emplaced over resistor 28, the trim action occurs through layer 34. Trimming of resistor 28 through $SiO_2$ layer 34 is accomplished by choosing a laser beam wavelength that passes through $SiO_2$ layer 34, with little absorption and is substantially absorbed by resistor 28. Such a laser beam is indicated at 36 in FIG. 1. Beam 36 should be focussed so that the heating effect is concentrated at the level of resistor 28. Beam 36 is scanned along the direction indicated by arrows 38 to create a region or cut 40 in the interior of resistor 28, to thereby alter the resistance seen between contacts 30 and 32. Cut 40 is made perpendicular to the direction of current flow 42 between contacts 30 and 32 and is further configured to be parallel to interfaces between resistor 28 and contacts 30, 32. It is to be noted that cut 40 is confined completely with the boundaries of resistor 28 and does not intersect or cross any such boundary. It should also be understood that additional cuts (e.g., 41 shown in phantom) can be made for further resistance value adjustment.

It has been found that when a laser beam 36 is employed to trim a thin film resistor 28, the cut is influenced by not only the incident beam, but also by reflections from underlying personalization layers. Further, when a trimming laser beam is caused to cross a boundary of resistor 28, the laser trim has been found to not always remove the material at the edge, thereby leaving filamentary bridges.

Figure 2:
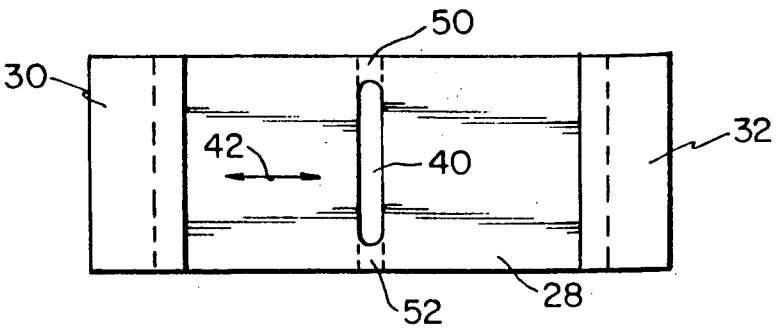
FIG. 2 is a plan view of the planar film resistor shown in FIG. 1.

By maintaining the trim cut totally within the confines of resistor 28, the problem of bridging at entry cuts into the resistor is completely avoided. Moreover, by making the trim-cut elongated and parallel to the interface between resistor 28 and contacts 30, 32 (and perpendicular to current flow 42), the greatest change in resistance between contacts 30, 32 can be achieved with the least amount of trim time. As can be seen in FIG. 2, the resistance seen between contacts 30 and 32 is largely controlled by the length and width of resistive areas 50 and 52 which remain after cut 40 is completed. It is preferred that the elongated dimension of the trim cut be substantially greater than the width of the cut. While only one cut 40 is shown, additional cuts can also be made, parallel to cut 40, to further alter the resistance of planar resistor 28.

Since resistor 28 is preferably trimmed while $SiO_2$ passivating layer 34 is already in place, the amount of heat and gases generated by the reaction between the beam 36 and resistor 28 must not cause $SiO_2$ layer 34 to be so stressed that it breaches and provides an opening that exposes resistor 28 to the atmosphere. Excellent results have been found to occur when planar film resistor 28 is a silicon-chrome mixture and exhibits a thickness of approximately 500 Angstroms. The thickness of $SiO_2$ layer 34 is approximately 3 microns and the wavelength of laser beam 36 is 1064 nanometers.

Under the above conditions, laser beam 36 causes a combined vaporization/chemical conversion reaction to occur at cut 40. Some of the chromium vaporizes, but because of the thinness of resistor material 28, the pressure buildup is not substantial. The vaporized chromium appears to be absorbed along the edges of the cut. In addition, a chemical conversion occurs, with the SiCr being converted to a much more highly resistive material.

Referring now to FIG. 3, a resistor configuration is shown that enables large resistance change values to be achieved with a minimum of trim actions. Resistor 28 has been laid down with a plurality of notches 60 formed therein. When interior trims 40 are subsequently made as shown in the finger region of resistor 28, the current flow path is greatly elongated. The resistor geometry of FIG. 3 exhibits substantial resistance value sensitivity to the amount of trim cut and allows a wide range of resistor values to be achieved.

In FIG. 4 a modification to the resistor geometry of FIG. 3 is shown wherein neck regions 62 disposed between notches 60 are metal rather than resistance material. This configuration also enables substantial change of resistance value per unit of trim action and a wide range of resistor values to be achieved.

It should be understood that the foregoing description is only illustrative of the invention. Various alternatives and modifications can be devised by those skilled in the art without departing from the invention. While various layer structures have been recited as underlying the thin film resistors, such structures have been included for exemplary purpose only and others may be present or substituted therefor. Accordingly, the present invention is intended to embrace all such alternatives, modifications and variances which fall within the scope of the appended claims.

We claim:

1. A planar film resistor which is trimmable by a laser beam, comprising:

a substrate;

a pair of electrodes spaced apart on said substrate; and a film of resistive material disposed between said electrodes and in contact therewith along parallel electrode/material interfaces, said resistive material including at least a trim region disposed internally to all boundaries of said resistive material, said trim region having an elongated dimension parallel to said electrode/material interfaces and a lesser width dimension parallel to the direction of most direct current flow between said electrodes.

2. The planar film resistor as recited in claim 1 further comprising:

at least one overlayer disposed over said electrodes and film of resistive material, said overlayer substantially transparent to said laser beam's wavelength, and wherein said trim region is created by said laser beam subsequent to the positioning of said overlayer over said resistive material.

3. The planar film resistor as defined in claim 2 wherein said film of resistive material is sufficiently thin that when it is laser trimmed, vaporized components of said resistive material do not cause a breach in said overlayer.

4. The planar film resistor as defined in claim 3 wherein said resistive material is SiCr and said film has a thickness of approximately 500 Angstroms.

5. The planar film resistor as recited in claim 4 wherein a plurality of trim regions are created in said film of resistive material, each said trim region disposed internally to all boundaries of resistive material and exhibiting an elongated dimension which is parallel to said electrode/material interfaces.

6. A planar film resistor which is trimmable by a laser beam, comprising:

a substrate;

a pair of electrodes spaced apart on said substrate; and a film of resistive material disposed between said electrodes and in contact therewith along parallel electrode/material interfaces, said film exhibiting a geometry comprising a plurality of fingers of resistive material disposed between said contacts, said fingers separated by notch regions and interconnected by narrowed regions of resistive material, at least one of said fingers including a trim region disposed internally to all boundaries of said finger, said trim region having an elongated dimension parallel to said electrode/material interfaces and a lesser width dimension parallel to the direction of overall current flow through said resistor.

7. The planar film resistor as recited in claim 6 wherein said notch regions are diametrically opposed and said narrowed regions of resistive material separate said opposed notch regions.

8. The planar film resistor as recited in claim 6 wherein said narrowed resistive material regions are replaced by metallic conductor narrowed regions.

9. The planar film resistor as recited in claim 7 further comprising:

at least an overlayer disposed over said electrodes and film of resistive material, said overlayer substantially transparent to said laser beam's wavelength, and wherein said trim region is created by said laser beam subsequent to the positioning of said overlayer over said resistive material.

10. The planar film resistor as recited in claim 8 further comprising:

at least an overlayer disposed over said electrodes and film of resistive material, said overlayer substantially transparent to said laser beam's wavelength, and wherein said trim region is created by said laser beam subsequent to the positioning of said overlayer over said resistive material.

11. A method for trimming a planar thin film resistor by means of a laser beam, said resistor including two parallel electrodes in contact along parallel interface lines with opposite ends of said resistor, said method comprising:

making a trim cut parallel to said interface lines of contact between said resistor and said electrodes, each said cut beginning and ending within the perimeter of said resistor, each said cut exhibiting an elongated dimension substantially greater than its width dimension, said elongated dimension parallel to said interface lines.

12. The method as defined in claim 11 wherein said trim cuts are made after at least one overlayer has been deposited over said planar thin film resistor.

13. The method as defined in claim 12 wherein said overlayer is substantially transparent to said laser beam.

14. A method for trimming a thin film planar resistor by means of a laser beam, the resistor comprising a silicon, chrome mixture and covered with an $SiO_2$ layer, said $SiO_2$ layer being substantially transparent to said laser beam, said resistor exhibiting a film thickness dimension on the order of 500 Angstroms, said method comprising:

making a trim cut in said thin film resistor by directing said laser beam at said resistor to cause an alteration in characteristics of said resistor by causing an entrapped vaporization of some of said silicon chromium mixture, whereby the film thickness dimension of said resistor limits the amount of vaporized material during the trim operation, thereby preventing any breach in the $SiO_2$ overlayer.

15. The method as defined in claim 14 wherein said trim cut begins and ends within the perimeter of said thin film resistor and does not intersect any perimeter thereof.

16. A planar film resistor which is trimmable by a laser beam, comprising:

a substrate;

a pair of electrodes spaced apart on said substrate; and a film of resistive material disposed between said electrodes and in contact therewith, said resistive material including at least a trim region disposed internally to all boundaries of said resistive material, said trim region having an elongated dimension generally orthogonal to a most direct electrical path between said electrodes and extending beyond an area of said most direct electrical path between said electrodes.

17. The planar resistor of claim 16 wherein said resistive material extends laterally beyond the extents of said electrodes.

* * * * *